US005647766A

United States Patent [19]

Nguyen

[11] Patent Number: 5,647,766

[45] Date of Patent: Jul. 15, 1997

[54] MODULAR CONNECTOR ASSEMBLY HAVING REMOVABLE CONTACTS

[75] Inventor: Hung Thai Nguyen, Harrisburg, Pa.

[73] Assignee: The Whitaker Corporation, Wilmington, Del.

[21] Appl. No.: 451,331

[22] Filed: May 26, 1995

[51] Int. Cl.[6] ..... H01R 13/66

[52] U.S. Cl. ..... 439/620; 439/607; 439/103

[58] Field of Search ..... 439/608, 620, 439/95, 607, 609, 103

[56] References Cited

U.S. PATENT DOCUMENTS

| | | | |
|---|---|---|---|
| 3,617,958 | 11/1971 | Schor et al. | 333/79 |
| 3,743,979 | 7/1973 | Schor | 333/79 |
| 3,803,537 | 4/1974 | Cobaugh et al. | 339/256 |
| 3,850,498 | 11/1974 | Schor | 339/147 |
| 3,854,107 | 12/1974 | Tuchto et al. | 333/79 |
| 3,961,295 | 6/1976 | Hollyday et al. | 333/79 |
| 4,083,022 | 4/1978 | Nijman | 333/79 |
| 4,126,370 | 11/1978 | Nijman | 339/143 |
| 4,260,966 | 4/1981 | Boutros | 439/608 |
| 4,376,922 | 3/1983 | Muzslay | 333/182 |
| 4,458,220 | 7/1984 | Carter et al. | 333/182 |
| 4,507,630 | 3/1985 | Wakino | 333/182 |
| 4,572,600 | 2/1986 | Nieman | 339/14 |
| 4,600,262 | 7/1986 | Nieman et al. | 339/147 |
| 4,741,710 | 5/1988 | Hogan et al. | 439/620 |
| 4,773,880 | 9/1988 | Sutton et al. | 439/620 |
| 4,820,174 | 4/1989 | Farrar et al. | 439/95 |
| 4,940,429 | 7/1990 | Chambers et al. | 439/608 |
| 4,950,185 | 8/1990 | Boutros | 439/620 |
| 5,219,296 | 6/1993 | Nguyen | 439/95 |
| 5,336,115 | 8/1994 | Paulus | 439/620 |

*Primary Examiner*—Khiem Nguyen
*Assistant Examiner*—Yong Ki Kim

[57] ABSTRACT

A filtered electrical connector, comprising a plurality of removable contacts, a housing having first contact receiving passages therein into which the contacts are removably secured, and an outer metal shell in which the housing is secured. The connector including a capacitor array having a plurality of tube capacitors secured together. Each of the tube capacitors have a second contact receiving passage with a signal electrode therein. A resilient member to provide a releasable electrical connection from the contact to the signal electrode is disposed in the second passage. A continuous ground electrode is isolated from the signal electrode and completely surrounds the second passage. The ground electrode being electrically connected to the shell. The contacts are removable by releasing the retaining clip and sliding the contact out of the resilient member.

8 Claims, 6 Drawing Sheets

MODULAR CONNECTOR ASSEMBLY HAVING REMOVABLE CONTACTS

FIELD OF INVENTION

The present invention relates generally to electrical connector assemblies, and more particularly, to filtered connector assemblies having removable contacts.

BACKGROUND OF THE INVENTION

High-density, multiple-contact, electrical connectors are used in many applications. In aircraft, for example, such connectors are often used to interface wiring from various locations throughout the aircraft with processing circuitry located within a bulkhead of the aircraft.

For convenience and flexibility, it is known to manufacture such connectors in the form of modular assemblies in which one or more connector modules or inserts are supported within an outer shell. Both the outer shell and the inserts are manufactured in a variety of standard configurations; and to form a connector assembly suitable for a particular application, it is only necessary to select the appropriate shell and inserts and mount the insert within the shell. The assembly as a whole can then be mounted to a bulkhead or other mounting surface for use.

For even greater flexibility, the inserts are removably mounted within the shell. Accordingly, if replacement of a particular insert is desired, it is a simple matter to remove the insert from the shell and mount a new insert in its place. It is not necessary to replace the assembly as a whole or to interfere with other inserts in the assembly.

There are many applications in which it is desirable to provide a connector insert with a filtering capability; for example, to suppress EMI or RFI interference or other undesired signals which may exist in circuits connected by the inserts. To retain the convenience and flexibility of the connector assemblies, however, it is desirable that the filtering capability be incorporated into the inserts in a manner that will permit full interchangeability between the filtered inserts and their unfiltered counterparts. In particular, any filter insert should retain substantially the same dimensions as the corresponding unfiltered insert so that either can be mounted within the same aperture in a standard shell. Also, both the filtered and unfiltered versions of an insert should have the same contact placement so that either can be connected to appropriate mating connectors. In addition, any filter should be capable of being mounted to a shell in a removable manner to retain the flexibility of the assembly.

Typically, filtered, multiple-contact connectors have the filtering device soldered to the tail of the contact, as is shown in U.S. Pat. No. 4,820,174. Alternatively, the filtering device is provided in a module which includes the filtering devices for several signal contacts and can only be removed as a unit, as is shown in U.S. Pat. No. 5,219,296. If one pin contact was damaged in the former, it would be very difficult to remove the contact because the filtering device would have to be removed also. If one pin contact were damaged in the latter, the whole module would need to be removed.

Other filtered connectors are known having removable contacts. U.S. Pat. No. 4,940,429 shows an electrical connector having a planar array of capacitors with spring clips for releasably receiving the contacts therein. However, planar capacitor arrays are subject to cross talk between adjacent signals because the electrodes are coupled together in the planar array. When a tube capacitor is used, every contact has a ground electrode surrounding the signal electrode, thereby reducing the amount of cross talk between the signals.

It would be an advantage to have a filtered connector where each individual pin contact may be removed if it becomes damaged and where tube capacitors are used to reduce cross talk between the contacts.

SUMMARY OF THE INVENTION

The present invention is directed towards a filtered electrical connector which comprises a plurality of removable contacts, a housing having first contact receiving passages therein into which the contacts are removably secured, and an outer metal shell in which the housing is secured. The connector includes a capacitor array having a plurality of tube capacitors secured together. Each of the tube capacitors have a second contact receiving passage with a signal electrode therein. A resilient member to provide a releasable electrical connection from the contact to the signal electrode is disposed in the second passage. A continuous ground electrode is isolated from the signal electrode and completely surrounds the second passage. The ground electrode is electrically connected to the shell. The contacts are removable by releasing the retaining clip and sliding the contact out of the resilient member.

BRIEF DESCRIPTION OF THE DRAWINGS

Embodiments of the present invention will now be described by the way of example with reference to the accompanying drawings, in which.

Figure 7:
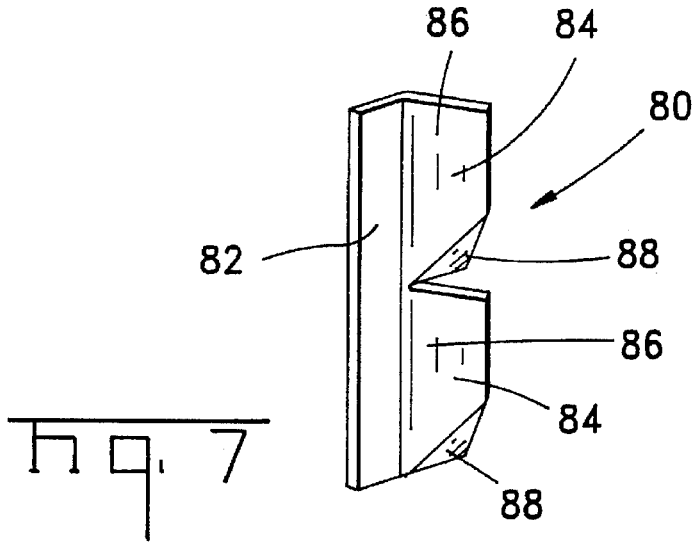
Figure 8:
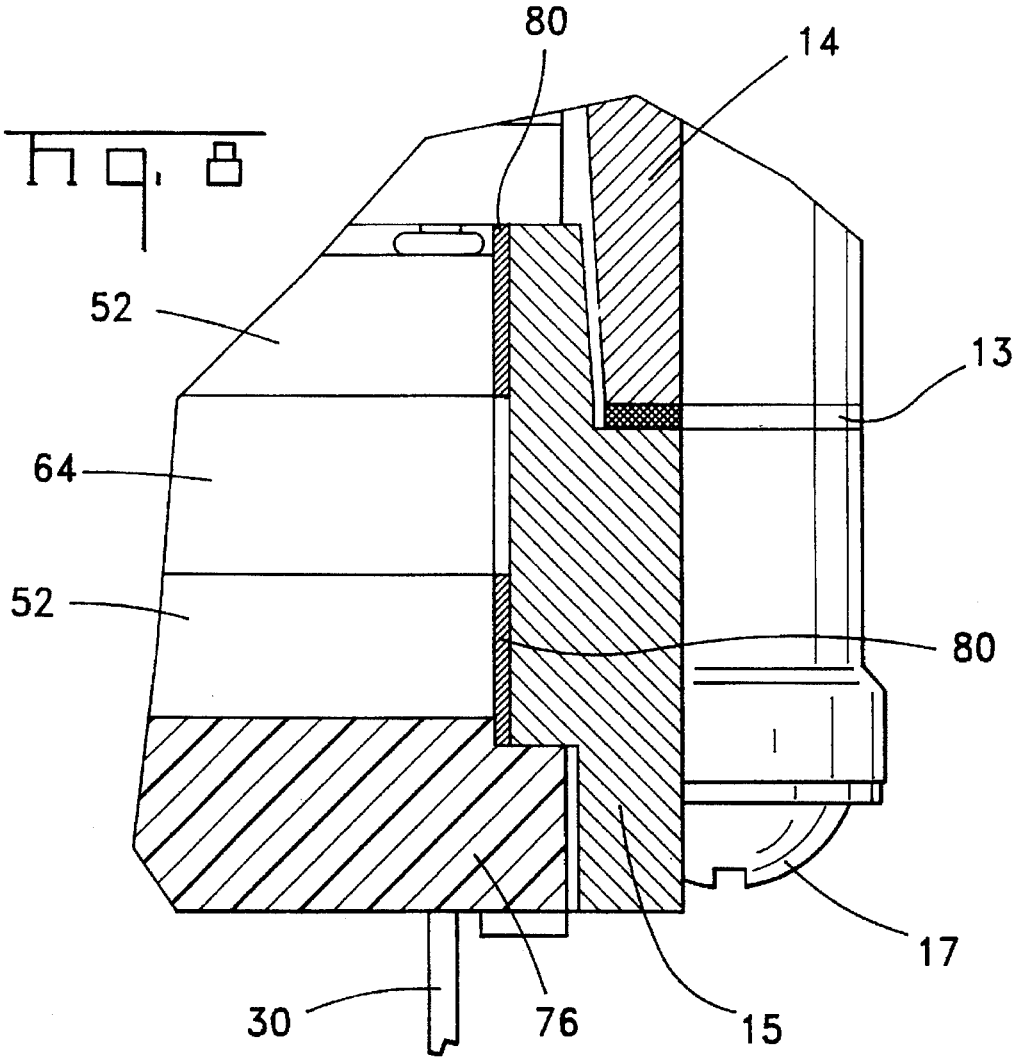

FIG. **6*a*** is a partial cross sectional view of the miniature spring socket;

FIG. 7 is a perspective view of a ground strip;

FIG. 8 is a cross sectional view showing the ground strip in the connector.

Figure 1:
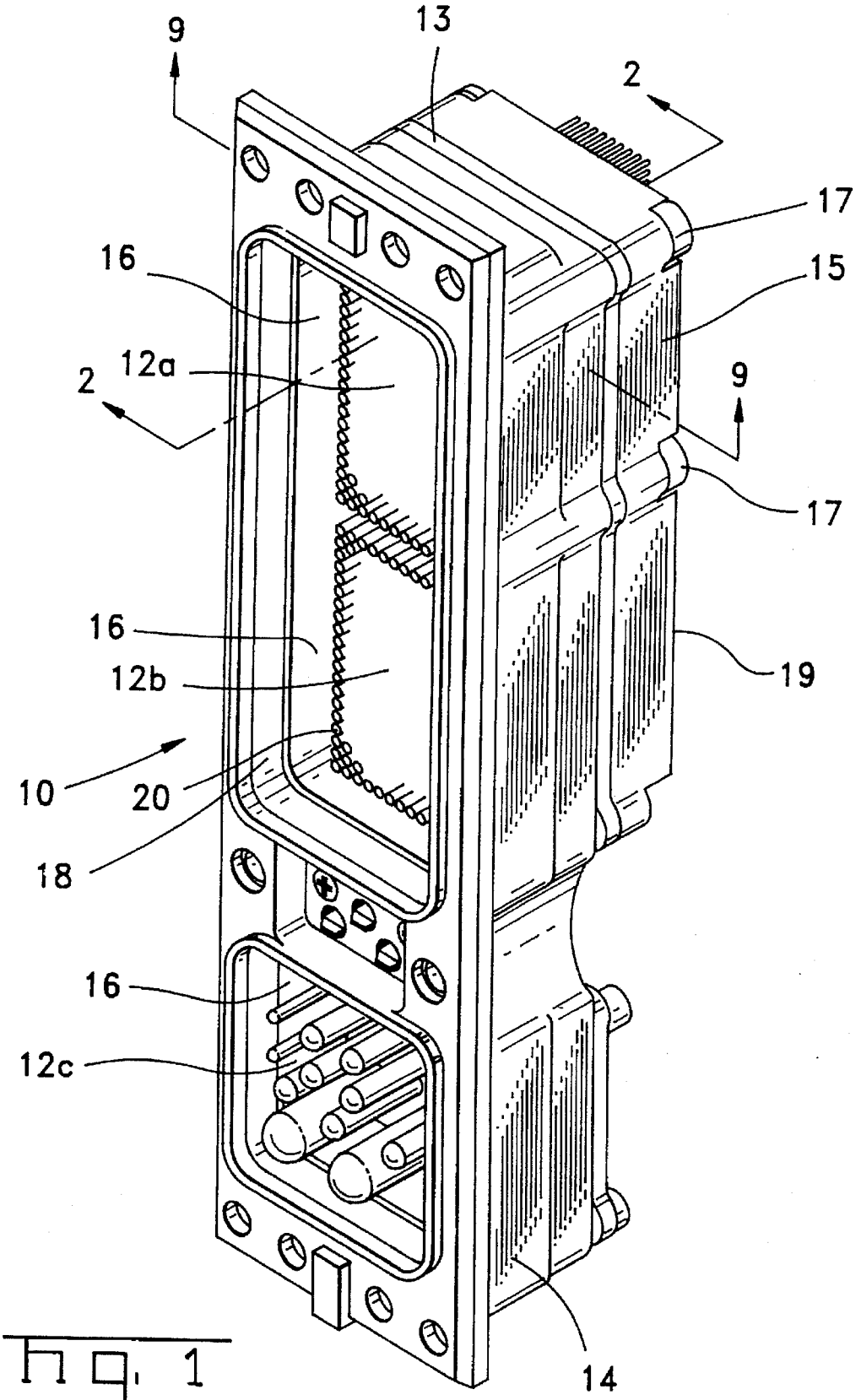
FIG. 1 is a perspective view of a modular connector assembly.
Figure 9:
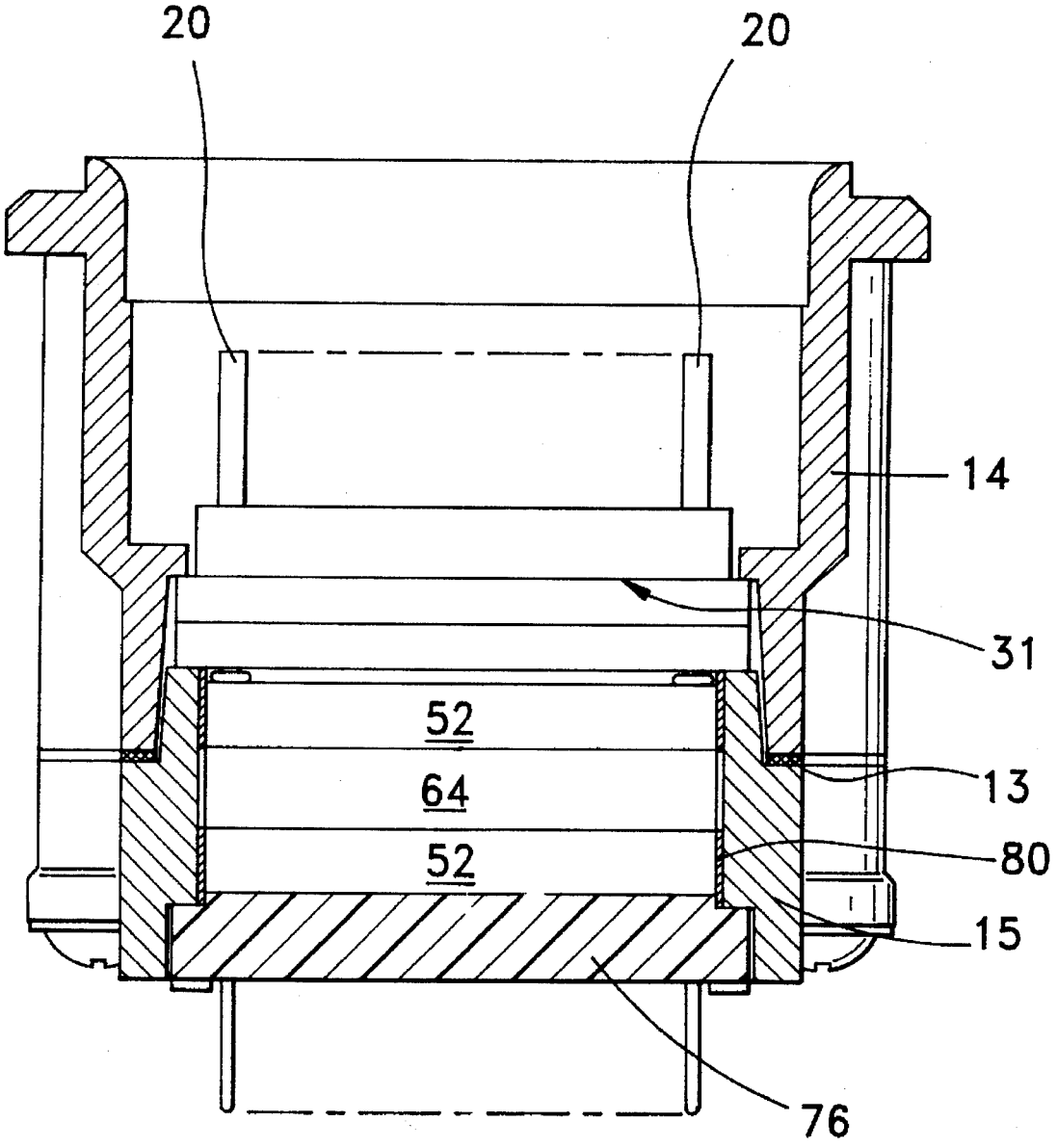

FIG. 9 is a cross sectional view of an assembled connector according to the teachings of the present invention the section taken along the plane 9—9 as shown in FIG. 1 of the drawings.

DETAILED DESCRIPTION OF THE INVENTION

FIG. 1 illustrates an electrical connector 10 of the current invention. The connector includes subassemblies **12*a*, 12*b*, 12*c* supported within a metallic outer shell 14. The connector 10 is configured with a plurality of apertures 16 the subassemblies 12*a*, 12*b*, 12*c* being adapted to be received within the apertures 16. A rear outer shell 15 is secured to the back of the outer shell 14 in a manner that is well known in the art. The shell 15 is secured by screws 17 and has an EMI gasket 13 secured between the rear outer shell 15 and the outer shell 14. The connector 10 has a mating surface 18 and a back surface 19**.

For convenience and flexibility, the connector 10 is of modular construction. The outer shell 14 and the subassemblies 12*a*, 12*b*, 12*c* are manufactured in a variety of configurations. The connector 10 shown in FIG. 1 has three apertures 16 for supporting three subassemblies.

Other shell configurations may be provided to support one or any desired plurality of inserts, and it is not intended to limit the invention to any particular shell configuration. Similarly, in the embodiment illustrated in FIG. 1, insert configurations are shown which differ in the number, type and placement of their contacts. These are intended to be exemplary only, and it is also not intended to restrict the invention to any particular insert configuration.

The connector 10 has a plurality of contacts 20 within the subassemblies 12*a*, 12*b*, 12*c*. The contact 20 has a mating section 22, a securing section 24 with a shoulder 26, a tail section 28 which extends through the filtering devices, and a termination section 30 for electrical termination, see FIG. 3.

Briefly, the connector 10 has a pi-type filter housed within the interior 21 of the rear shell 15. The subassembly has a forward housing 31 in which the contact is releasably secured; a first capacitor array 52, a dielectric housing 64 with ferrite beads 72, a second capacitor array 52, and a rear insert 76 which acts as a bottom cover.

Figures 2, 3:
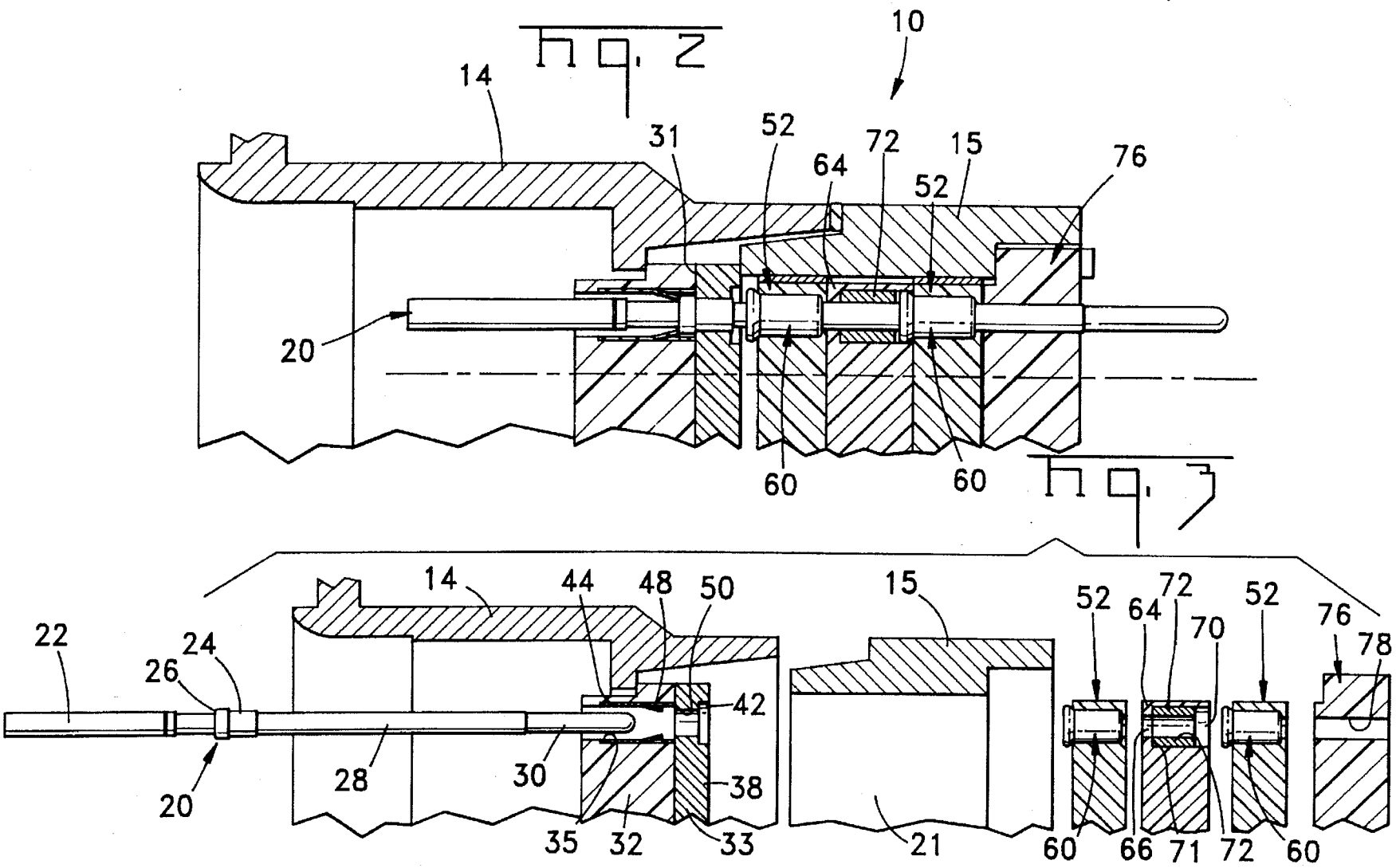
FIG. 2 is a cross sectional along the line 2—2 showing the contact and the filtering devices.
FIG. 3 is an exploded cross sectional view similar to FIG. 2.
Figure 4:
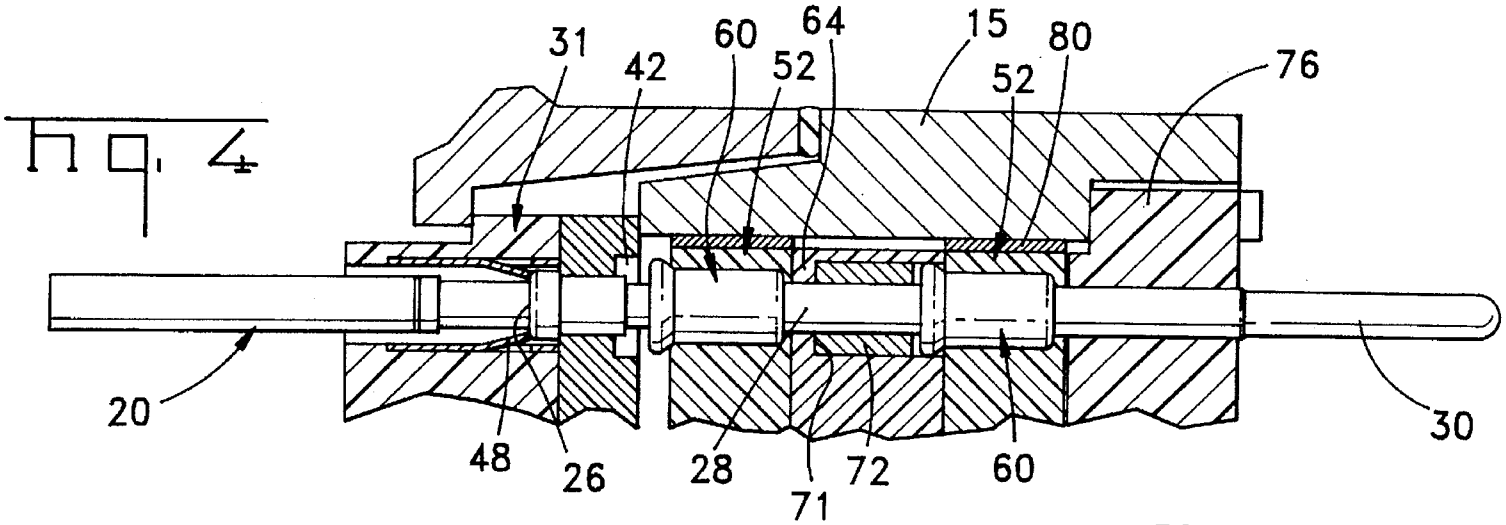
FIG. 4 is an enlarged cross sectional similar to FIG. 2.

Referring to FIGS. 2, 3 and 4 in greater detail, the subassembly 12 has a forward housing 31 which is made up of two housings 32, 33. Housing 32, 33 has a plurality of contact receiving apertures 35, 50 respectively, of which only one of each is shown in FIGS. 2, 3 and 4 for simplicity. Aperture 35 has a contact retaining clip 44 secured therein. The clip 44 is a cylindrical sleeve which is designed to be secured snugly within the aperture 35. The clip 44 has arms 48 which extend inwardly into the aperture and which are designed to engage shoulder 26 and secure the contact 20 within the aperture 35. After the retaining clip 44 is secured in aperture 35, the housings 32, 33 are bonded together to form the forward housing 31 which is then secured to the outer metal shell 14. In the preferred embodiment, aperture 35 has an enlarged portion along the back end 38. The enlarged portion forms a circular recess 42 along the back end of the forward housing 31.

Next, the capacitor array 52 will be described in more detail with reference to FIG. 6. The capacitor array 52 is a series of tube capacitors 53 which have been secured together by fusing so that they can be handled as a single unit. The array can include a variety of different numbers of tube capacitors. This embodiment has fifty individual tube capacitors. The array has a plurality of apertures 54, each with a conductive electrode therein to form the signal side of the capacitor. The individual tube capacitors each have a ground electrode surrounding the outer side of the tube capacitor 53. When the tube capacitors are fused together to form the capacitor array, a continuous ground array 56 is formed which surrounds the entire capacitor array 52 and also surrounds each individual aperture 54 to form the ground electrode of the capacitor.

Figure 5A:
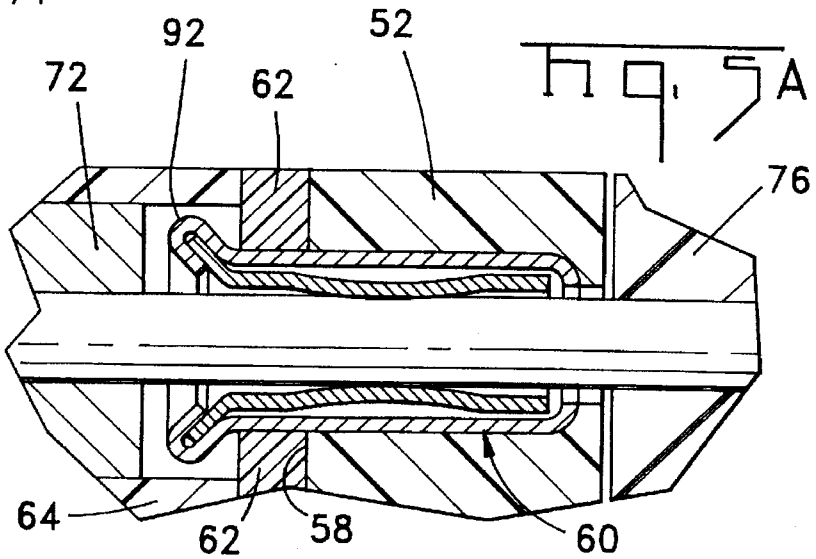
FIG. 5A is a cross section similar to FIG. 5 and showing a printed circuit board mounted on the top of the capacitor array.

In the preferred embodiment, a printed circuit board 62 is secured along the top wall 58 of the capacitor array 52, see FIG. 5A. A miniature spring socket 60 is secured in the opening of the aperture 54 to provide electrical connection to the signal side of the capacitor. The use of the printed circuit board 62 is preferred to facilitate the use of automation in the insertion of the spring socket 60 within the aperture 54. The capacitor array 52 can also be used without the printed circuit board. In that case, the spring sockets 60 are inserted and secured in the aperture 54 by hand.

The use of the miniature spring socket 60 within the aperture 54 allows electrical connection between the contact 20 and the capacitor array 52 without soldering the contact to the capacitor array 52. This makes individual contacts 20 easily removable from the capacitor array 52.

Figure 5:
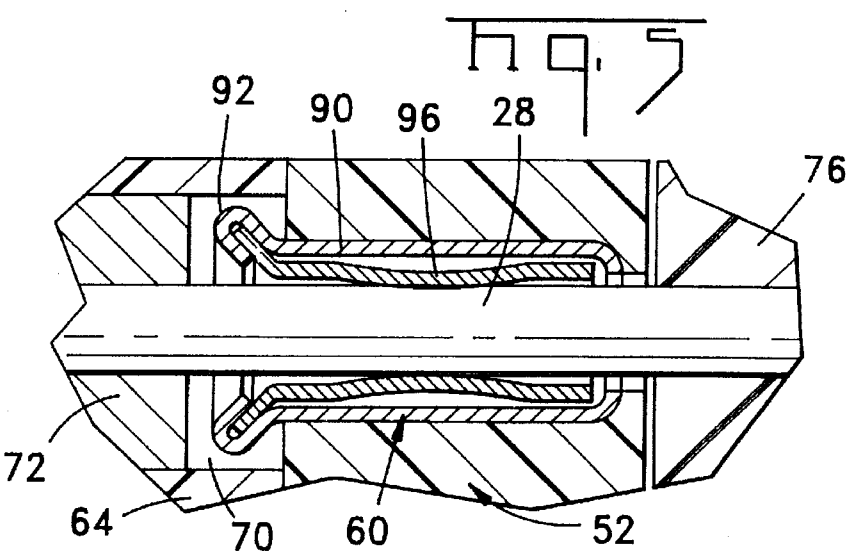
FIG. 5 is a cross sectional showing a miniature spring socket in a capacitor array.
Figure 6A:
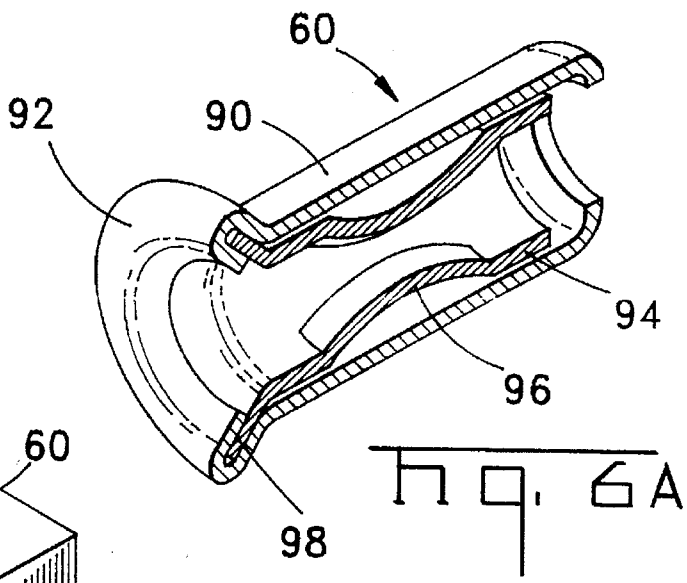
FIG. 6 is a top view of the capacitor array.
Figure 6:
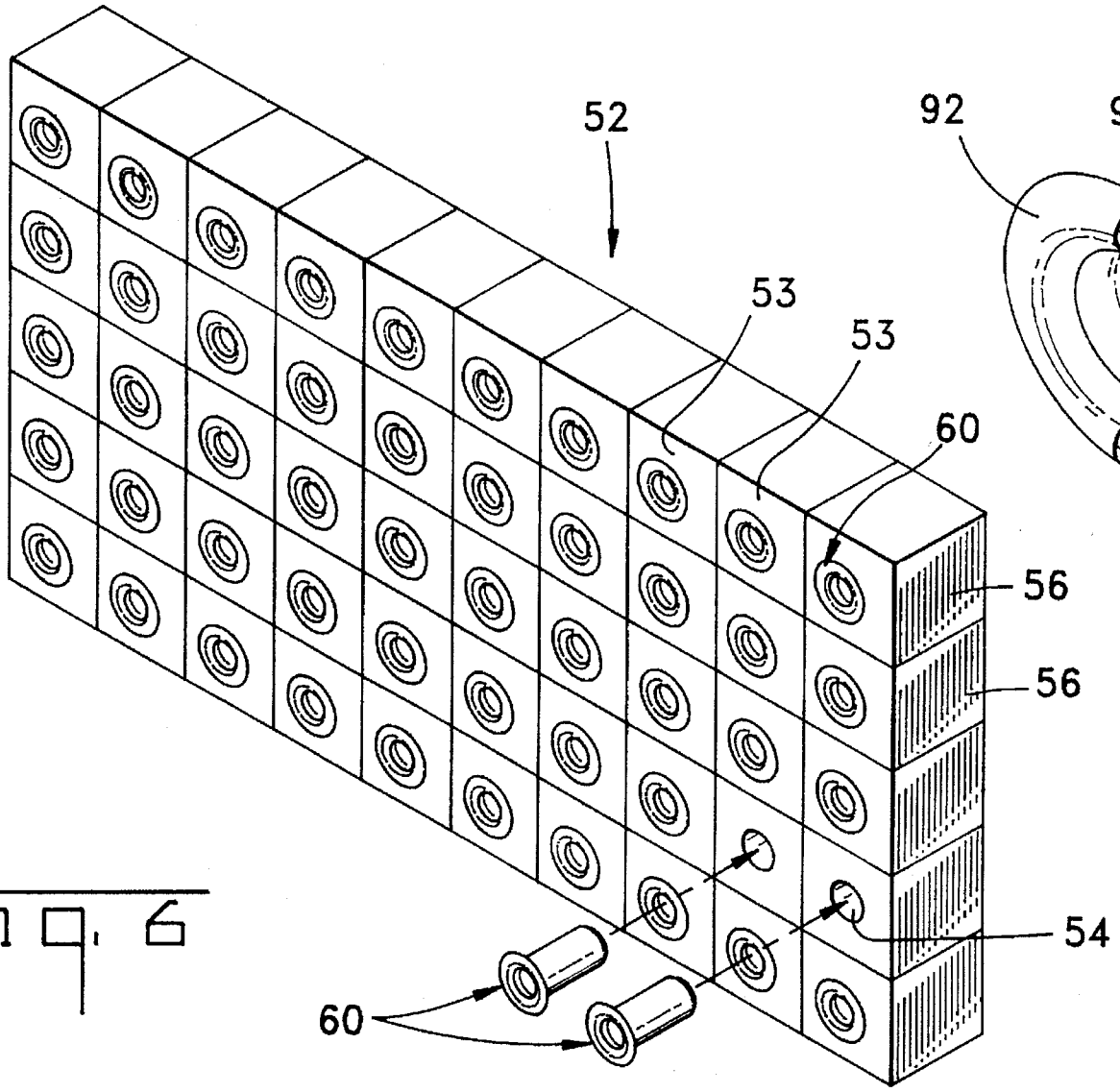

The miniature spring socket 60 has an outer cylindrical sleeve 90, see FIG. 6*a*, with an enlarged circular lip 92. The cylindrical sleeve 90 is designed to fit snugly within the aperture 54. The sleeve 90 contains an electrical receptacle 94. The receptacle 94 contains a pair of elongated resilient spring arms 96. Alternatively, the receptacle could contain a multiple number of spring arms 96. The top 98 of the receptacle 94 is received in the portion of the circular lip 92 which has been folded over thereby securing the receptacle within the sleeve 90. The miniature spring socket 60 is received into the aperture 54 in a tight fit to provide an electrical connection to the signal layer within the aperture 54. The circular lip 92 extends above the top of the ground array 52, or above the top of the printed circuit board 62 in the preferred embodiment. The tail section 28 of the contact 20 is received through the miniature spring socket 60 and the resilient spring arms 96 are deflected by the insertion of the tail section 28 thereby forming good electrical contact between the contact 20 and the spring socket 60, see FIG. 5

Next to the first capacitor array 52 is a dielectric housing 64 having a plurality of contact receiving apertures 66. The aperture 66 has a rearward portion 70 which is wider with a shoulder 71 therebetween. The wider portion 70 is adapted to receive a circular ferrite bead 72 therein. The shoulder 71 prevents the ferrite beads 72 from moving further forward in the connector. The ferrite beads 72 each have an aperture to receive the tail section 28 of the contact 20 therethrough.

Next to the dielectric housing 64 is a second capacitor array 52, which is constructed in a similar manner as the first capacitor array 52. The second capacitor array 52 can either have the printed circuit board 62 secured on top or not for the reasons that were described above. While the capacitor arrays 52 are of similar construction, they can be formed having different capacitances depending on the need in the connector.

A ground strip 80 is received between all sides of both of the capacitor arrays 52 and the rear shell 15. As is shown in FIG. 7, the ground strip 80 has a carrier portion 82 and square leaves 84 extending therefrom. Each leaf 84 is slightly spaced from adjacent leaves. The leaves 84 are stamped and formed into two sections 86, 88. The first section 86 is angled from the carrier portion so that it is no longer in the same plane as the carrier portion 82 (the first section 86 is angled forwardly as viewed in FIG. 7). The second section 88 is angled from the first section (angled downwardly as observed in FIG. 7). The angled sections 86, 88 form a resilient contact strip which can be inserted between the outer wall of the ground arrays 52 and the rear shell 15. The ground strip 80 is inserted between the array and the shell after they are in place. The carrier portion 82 is inserted first and the angled sections 86, 88 are compressed as they follow in between the array and the shell thereby forming good electrical contact therebetween. An adhesive can be applied along one side of the carrier portion 82 to secure the ground strip 80 in place.

Finally, there is a dielectric rear insert 76 with a plurality of contact receiving aperture 78. The rear insert 76 is received within the interior 21 of the rear shell 15 in a snug fit so that all of the other components are secured within the outer shell.

The method of assembling the connector will now be described in detail. The rear shell 15 is first secured to the shell 14, with the EMI gasket 13 secured therebetween, using screws 17 to form the interior section 21 into which the filter components will be received. A few contacts 20 may be inserted through the forward housing 31 so that the tail sections 28 are received into the interior section 21 of the connector and can serve to guide the components into their proper place.

Next, the first capacitor arrays 52 can be inserted into the interior section 21 of the connector from the back surface 19. The contact tail sections 28 that have already been inserted into the connector are received through the appropriate spring socket 60 and the aperture 54 and serve to guide the array 52 into position. The enlarged circular lip 92 of the miniature spring socket 60 is received into the recess 42 which serves to keep the array 52 in alignment. The number of ground arrays 52 that are inserted into the interior section 21 is dependent upon the number of contacts that are in each section and the number of tube capacitors 53 that make up the individual capacitor arrays 52. Ground strips 80 are placed between the rear shell 15 and the capacitor arrays 52.

The wider portion 70 of housing 64 is filled with ferrite beads 72 which are then inserted together into the interior portion 21. The tail section 28 on the contacts 20 that have already been placed in position are received through apertures 66 and 74. Next, the second capacitor array 52 is inserted into the interior portion 21. The circular lip 92 of the miniature spring sockets 60 are received into the back end of the wider portion 70. This serves to keep the second capacitor arrays 52' in proper alignment. Ground strips 80 are place between the rear shell 15 and the second capacitor arrays 52'. Finally, the rear insert 76 is put in place in the back end 19 of the connector and the tail sections are received through the apertures 78. The other contacts 20 can then be inserted through the apertures until they are locked in place by the arms 48 of the retaining clip 44 engaging shoulders 26 of the contact 20.

The connector of the present invention allows the contacts 20 to be individually inserted and removed. Removal of the contacts is achieved by a tool which is well known in the art. The tool is inserted around the mating section 22 and into aperture 35. The tool pushes the arm 48 of the retaining clip 44 out of engagement with the shoulder 26. The contact 20 can then be removed because it has not been soldered to any of the filtering components, therefore an individual contact can be removed and replaced in the event that it becomes damaged.

The electrical connector of the present invention and many of its attendant advantages will be understood from the foregoing description. It is apparent that various changes may be made in the form, construction, and arrangement of parts thereof without departing from the spirit or scope of the invention, or sacrificing all of its material advantages.

We claim:

1. A filtered electrical connector, comprising:

a housing having first contact receiving passages an outer metal shell in which the housing is secured;

first and second capacitor arrays, each capacitor array having a plurality of tube capacitors secured together, each of said tube capacitors having a second contact receiving passage with a signal electrode therein, a resilient member electrically connected to the signal electrode, a continuous ground electrode isolated from the signal electrode and completely surrounding the second contact receiving passage, the ground electrode being electrically connected to said shell;

a second housing having ferrite beads with apertures therein, and a plurality of removable contacts received by said first capacitor array, said apertures in said ferrite beads and said second capacitor array each said contact in electrical contact with one of said resilient members and retained by a retaining clip.

2. The electrical connector of claim 1, wherein the resilient member is a spring socket.

3. The electrical connector of claim 1, wherein the contact has a shoulder and a tail section, the shoulder is engaged by the retaining clip in the housing to releasably secure the contact therein, the tail section is received through a spring socket in the first capacitor array, the dielectric housing and the ferrite bead, and a spring socket in the second capacitor array.

4. The electrical connector of claim 3, wherein the spring socket comprises an outer sleeve and an inner receptacle secured therein, the outer sleeve includes an upper lip which extends above a top surface of the capacitor array.

5. The electrical connector of claim 4, wherein the dielectric housing has contact receiving passages to receive both the ferrite bead and the contacts, the upper lip of the spring sockets on the second capacitor array are received within the contact receiving passage, next to the ferrite bead, thereby keeping the second capacitor array in alignment.

6. The electrical connector of claim 2, wherein an upper lip of each said spring socket is received within the contact receiving passage, thereby keeping the capacitor arrays in alignment.

7. The electrical connector of claim 1, wherein the capacitor array is electrically connected to the shell by way of a ground strip which includes a planar carrier portion and resilient leafs which are bent at an angle from the carrier portion.

8. The electrical connector of claim 1, wherein the shell comprises a forward shell and a rear shell secured thereto by screws, an EMI gasket being received between the forward shell and the rear shell to prevent leakage of radiation.

* * * * *